US011052673B2

(12) United States Patent
Fujita

(10) Patent No.: US 11,052,673 B2
(45) Date of Patent: Jul. 6, 2021

(54) PRINTING SYSTEM

(71) Applicant: Brother Kogyo Kabushiki Kaisha, Nagoya (JP)

(72) Inventor: Keisuke Fujita, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 70 days.

(21) Appl. No.: 16/669,876

(22) Filed: Oct. 31, 2019

(65) Prior Publication Data

US 2020/0130369 A1 Apr. 30, 2020

(30) Foreign Application Priority Data

Oct. 31, 2018 (JP) ..... JP2018-206083

(51) Int. Cl.
*B41J 2/325* (2006.01)
*B41J 33/54* (2006.01)

(52) U.S. Cl.
CPC ..... *B41J 2/325* (2013.01); *B41J 33/54* (2013.01)

(58) Field of Classification Search
CPC ..... B41J 2/325; B41J 33/54
See application file for complete search history.

(56) References Cited

U.S. PATENT DOCUMENTS 5,248,994 A 9/1993 Yoshida et al.
5,369,422 A 11/1994 Yoshida et al.
5,380,394 A 1/1995 Shibuya et al.
6,247,859 B1 6/2001 Butcher
6,307,583 B1 * 10/2001 Randolph ..... B41J 33/26 347/217
10,315,437 B2 6/2019 Hart et al.
2017/0326887 A1 11/2017 Hart et al.

FOREIGN PATENT DOCUMENTS

CN 1041564 A 4/1990
CN 1185769 A 6/1998
CN 107107631 A 8/2017
JP H08-011405 A 1/1996
JP 2000-103102 A 4/2000

OTHER PUBLICATIONS

Apr. 9, 2020—(EP) Extended EP Search Report—App 19205714.9.
Sep. 22, 2020—(CN) Notification of First Office Action—App 201911050242.0, Eng Tran.

* cited by examiner

*Primary Examiner* — Justin Seo
(74) *Attorney, Agent, or Firm* — Banner & Witcoff, Ltd.

(57) ABSTRACT

A printing system includes: a printing device including a thermal head, a supplier, a winder, and a ribbon transport mechanism; and a controller configured to: transport an ink ribbon in a first direction from the supplier to the winder and heat the ink ribbon to perform printing; rewind the ink ribbon subjected to the printing in a second direction opposite to the first direction; after again receiving a print command, rewind the ink ribbon in the second direction by a first length corresponding to a length required to reach a printable speed; after the rewindings, store a second length corresponding to a length of the ink ribbon subjected to the printing upstream of the thermal head in the first direction; and feed the ink ribbon in the first direction by the stored second length.

10 Claims, 16 Drawing Sheets

FIG. 4

70

| MENU LIST | | | | |
|---|---|---|---|---|
| No. | REWIND FUNCTION | WIDTH OF INK RIBBON | FULL LENGTH OF INK RIBBON | TRANSPORT SPEED OF PACKAGING MATERIAL |
| 1 | FIRST | 100mm | 1000m | 300mm/sec |
| 2 | SECOND | 100mm | 1000m | 500mm/sec |
| 3 | THIRD | 80mm | 500m | 700mm/sec |
| 4 | OFF | 100mm | 1000m | 100mm/sec |
| ⋮ | ⋮ | ⋮ | ⋮ | ⋮ |
| ⋮ | ⋮ | ⋮ | ⋮ | ⋮ |
| ⋮ | ⋮ | ⋮ | ⋮ | ⋮ |

PRINTING SYSTEM

CROSS-REFERENCE TO RELATED APPLICATIONS

This application is based on and claims priority under 35 USC 119 from Japanese Patent Application No. 2018-206083 filed on Oct. 31, 2018, the contents of which are incorporated herein by reference.

TECHNICAL FIELD

The disclosure relates to a printing system.

BACKGROUND

There has been disclosed a thermal stamper that performs printing on a transported packaging material. The thermal stamper includes a thermal print head, a head drive unit, a transfer ribbon feed unit, a platen roller, and a control unit. The head drive unit moves the thermal print head up and down to a non-printing position and a printing position with respect to the packaging material. The transfer ribbon feed unit supplies and guides a transfer ribbon between the thermal print head and the packaging material. The control unit actuates the transfer ribbon feed unit to start feeding the transfer ribbon (hereinafter referred to as "forward feed") until the thermal print head comes in contact with the platen roller after the thermal print head starts moving-down to the printing position. When moving-down of the thermal print head to the printing position is completed, the control unit starts printing on the packaging material. During a printing period for the packaging material, when printing for a printing length is ended, the control unit actuates the head drive unit to start moving-up of the thermal print head to the non-printing position. At the stage of moving-up the thermal print head to the non-printing position, the control unit continues feeding the transfer ribbon at the same speed as that of the packaging material, without stopping feeding (hereinafter referred to as "rearward feed") the transfer ribbon even after the end of printing, until the thermal print head is separated from the platen roller. The control unit stops feeding the transfer ribbon at a time point when the thermal print head is separated from the platen roller. The control unit then rewinds the transfer ribbon in order to save the transfer ribbon. An amount of transfer ribbon to be rewound is an amount corresponding to a sum of a forward feed amount, a rearward feed amount, and a length of about 1 mm.

SUMMARY

One illustrative aspect of the disclosure may provide a printing system comprising: a printing device comprising: a thermal head; a supplier configured to supply an ink ribbon to the thermal head; a winder provided opposite to the supplier with respect to the thermal head and configured to wind the ink ribbon; and a ribbon transport mechanism configured to transport the ink ribbon between the supplier and the winder; an interface; a storage; and a controller configured to: transport the ink ribbon in a first direction with the ribbon transport mechanism and heat the ink ribbon with the thermal head to perform printing, the first direction being a direction from the supplier to the winder; perform a first rewinding comprising rewinding the ink ribbon subjected to the printing in a second direction with the ribbon transport mechanism, the second direction being opposite to the first direction; after again receiving a print command via the interface, perform a second rewinding comprising rewinding the ink ribbon by a first length in the second direction with the ribbon transport mechanism, the first length corresponding to a length required to reach a printable speed; after performing each of the first rewinding and the second rewinding, store, in the storage, a second length, the second length corresponding to a length of the ink ribbon subjected to the printing upstream of the thermal head in the first direction; and feed the ink ribbon in the first direction by the stored second length with the ribbon transport mechanism.

In the printing system, after each of the first rewinding process and the second rewinding process, the printed ribbon length positioned closer to the supply unit than the thermal head is stored in the storage unit. The feeding process of feeding the ink ribbon by the printed ribbon length stored in the storage unit is performed by the ribbon transport mechanism. The second rewinding process is performed after receiving a printing command again, and thus it is possible to prevent occurrence of an excess or deficiency in the rewinding amount of the ink ribbon.

Another illustrative aspect of the disclosure may provide a printing system comprising: a printing device comprising: a thermal head; a supplier configured to supply an ink ribbon to the thermal head; a winder provided opposite to the supplier with respect to the thermal head and configured to wind the ink ribbon; and a ribbon transport mechanism configured to transport the ink ribbon between the supplier and the winder; an interface; a storage; and a controller configured to: transport the ink ribbon in a first direction with the ribbon transport mechanism and heat the ink ribbon with the thermal head to perform printing, the first direction being a direction from the supplier to the winder; perform a first rewinding comprising rewinding the ink ribbon subjected to the printing in a second direction with the ribbon transport mechanism, the second direction being opposite to the first direction; after performing the first rewinding, store, in the storage, a second length, the second length corresponding to a length of the ink ribbon subjected to the printing upstream of the thermal head in the first direction; and after again receiving a print command via the interface, perform a difference transporting comprising: in a case the stored second length is longer than a third length, feeding the ink ribbon in the first direction by a difference length between the second length and the third length with the ribbon transport mechanism, the third length corresponding to a length of the ink ribbon required to reach a printable speed; and in a case the stored second length is equal to or less than the third length, rewinding the ink ribbon in the second direction by the difference length with the ribbon transport mechanism.

In the printing system described above, only the difference between the printed ribbon length stored in the storage unit and the predetermined length of the ink ribbon required to reach a printable speed is rewound or fed by the difference transport process, and thus the time for the difference transport process can be shortened, and the time to start printing can be shortened.

BRIEF DESCRIPTION OF DRAWINGS

Illustrative embodiments of the disclosure will be described in detail based on the following figures, wherein:

FIG. 4 is a table listing contents of a menu list;

DETAILED DESCRIPTION

Figure 14:
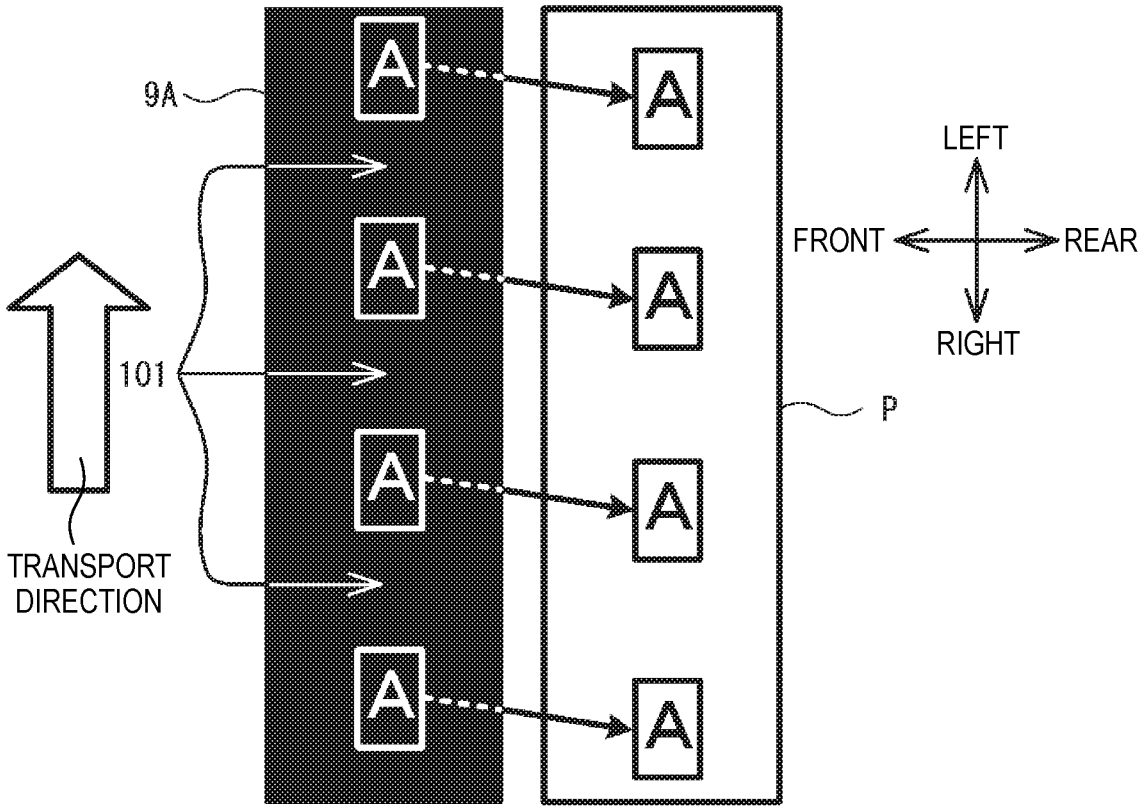
FIG. 14 is a view illustrating a used area of the ink ribbon in the related art.
Figure 15:
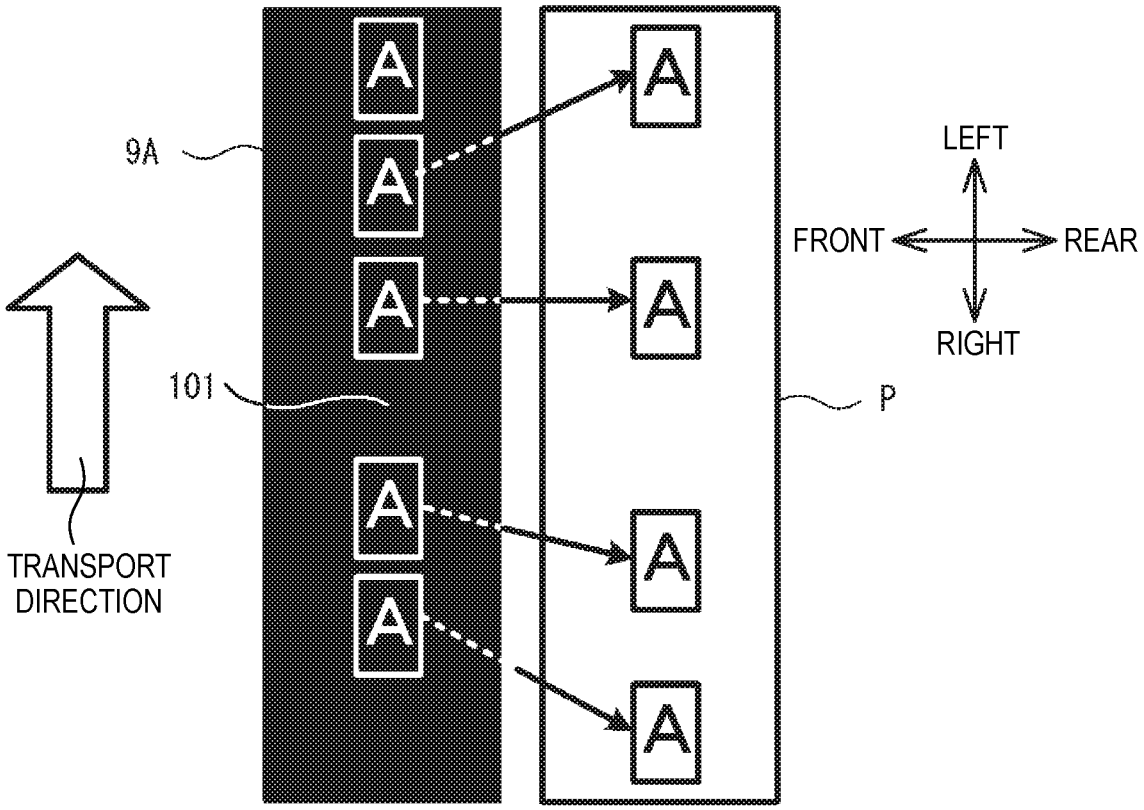
FIG. 15 is a view illustrating a used area of the ink ribbon for which a transport speed of the ink ribbon is set fast.
Figure 16:
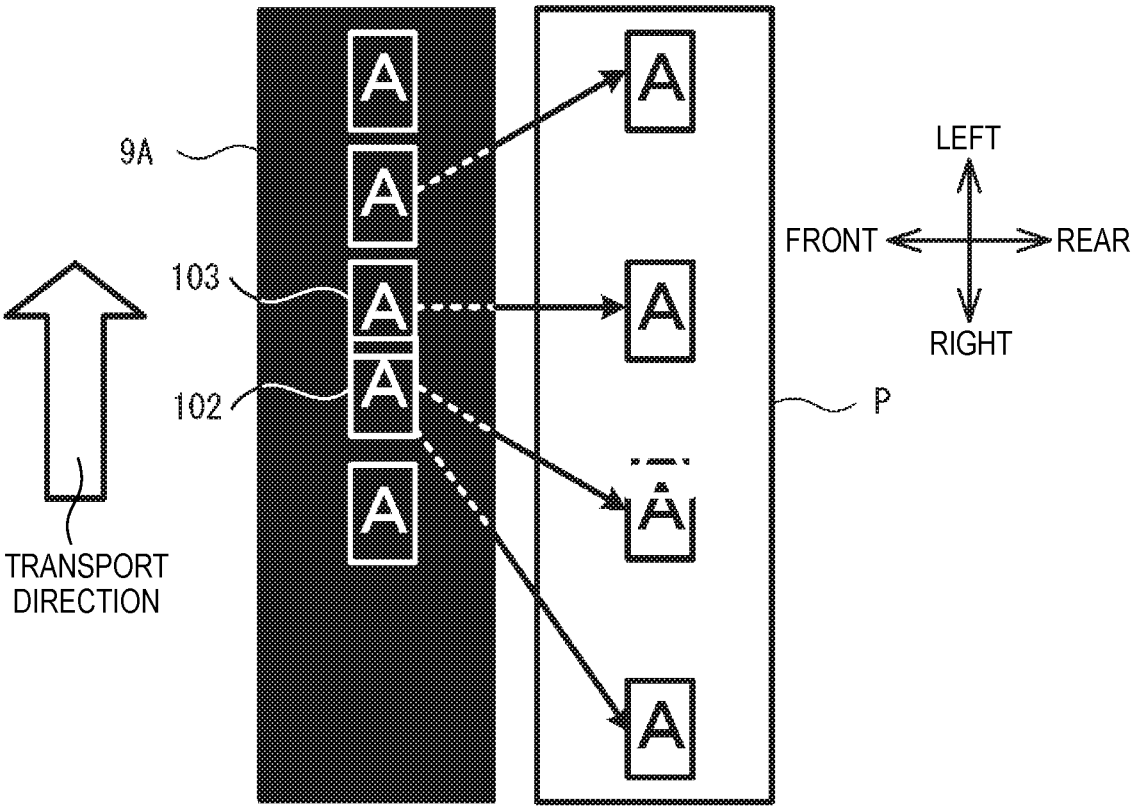
FIG. 16 is a view illustrating a uses area of the ink ribbon for which the transport speed of the ink ribbon is set slow.

In the related-art thermal stamper, as illustrated in FIG. 14, when the transfer ribbon 9A is not rewound, an unused area 101 transported by acceleration and deceleration of the transfer ribbon 9A is increased for printing on the transported packaging material (hereinafter, also referred to as a "print medium P"). In the thermal stamper, when settings such as printing speed are changed after printing is stopped in a state where a function to rewind the transfer ribbon 9A is enabled, an excess or deficiency in a rewinding amount of the transfer ribbon may occur in some cases. For example, as illustrated in FIG. 15, when a transport speed of the transfer ribbon 9A is set fast, the rewinding amount is insufficient and the unused region 101 of the transfer ribbon is increased. When the transport speed of the transfer ribbon 9A is set slow, as illustrated in FIG. 16, a used area 102 of the transfer ribbon 9A in the next printing overlaps the used area 103 of the transfer ribbon in the previous printing, resulting in unclear printing results, which is problematic.

Therefore, illustrative aspects of the disclosure provide a printing system having a rewind function of rewinding an ink ribbon, which prevents an excess or deficiency in a rewinding amount of the ink ribbon.)

Overview of Printing System 1

One illustrative embodiment of the disclosure will be described with reference to the drawings. The printing system 1 is a system for performing thermal transfer printing. The printing system 1 performs printing on a print medium P (see FIG. 2) transport by an external apparatus 8 (see FIG. 3). A specific example of the external apparatus 8 includes a packaging machine that transports the packaging material which is one example of the print medium P. In this case, for example, the printing system 1 is used by being incorporated into a part of a transport line on which the print medium P is transported by the packaging machine.

Figure 1:
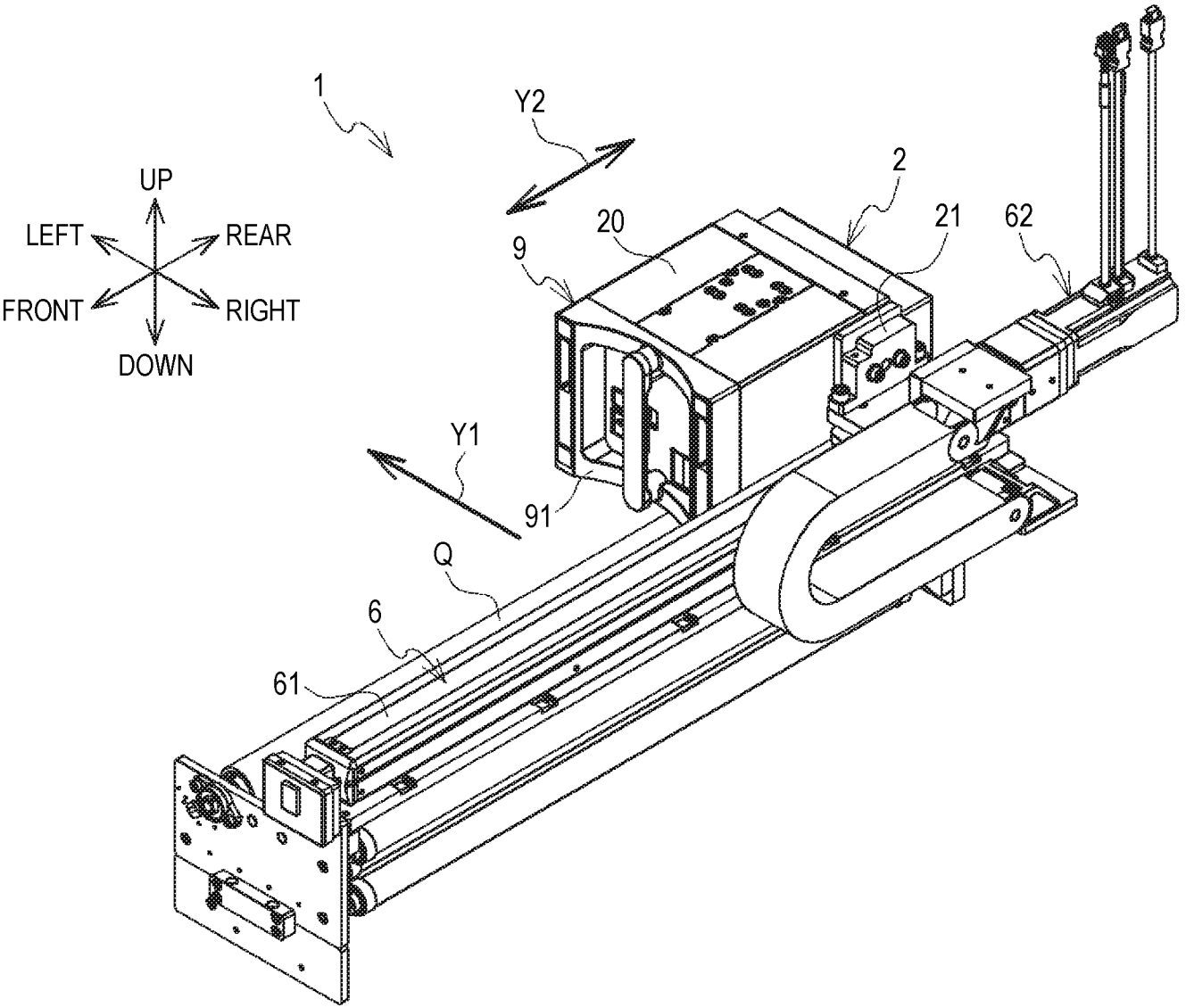
FIG. 1 is a perspective view of a printing system (in a state where a cassette is attached)

As illustrated in FIG. 1, the printing system 1 includes a printing device 2, a bracket 6, a controller 7 (see FIG. 3), and a platen roller Q. Hereinafter, in order to help understanding of the description of the drawings, the above, the below, the left, the right, the front, and the rear of each configuration included in the printing system 1 will be defined. The above, the below, the left, the right, the front, and the rear of the printing device 2 and the bracket 6 correspond to an upper side, a lower side, an obliquely upper left side, an obliquely lower right side, an obliquely lower left side, and an obliquely upper right side in FIG. 1, respectively. In FIG. 1, a transport direction of the print medium P coincides with the horizontal direction. The print medium P is transported in the left direction (direction of the arrow Y1) by the external apparatus 8.

Cassette 9

Figure 2:
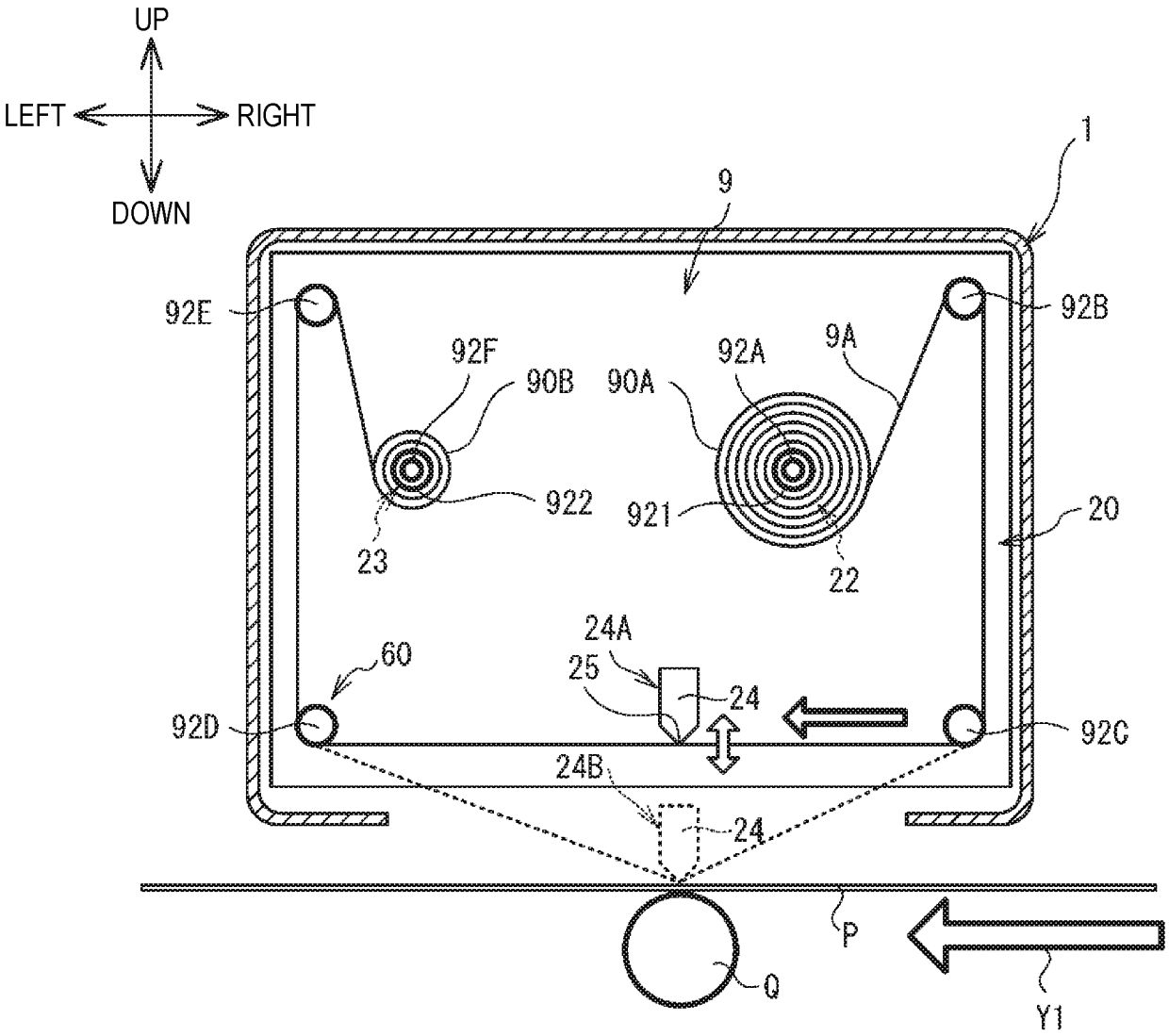
FIG. 2 is a diagram for explaining an operation of a printing device.

In the printing system 1, printing on the print medium P is performed in a state where the cassette 9 is attached to a cassette attachment unit 20 of the printing device 2. The printing device 2 performs printing by heating an ink ribbon 9A (see FIG. 2) of the cassette 9. As illustrated in FIG. 2, the cassette 9 includes a lid 91 (see FIG. 1), shafts 92A to 92F, a supply roll 90A, and a winding roll 90B. The shafts 92A to 92F are spindles that are rotatable around a rotation axis extending in the front-and-rear direction. The shafts 92A to 92F extend rearward from the rear surface of the lid 91.

The shafts 92A and 92F are arranged in the horizontal direction above the center of the lid 91 in the vertical direction. A spool 921 to which one end of the ink ribbon 9A is connected is attached to the shaft 92A. A spool 922 to which the other end of the ink ribbon 9A is connected is attached to the shaft 92F. In each of the spools 921 and 922, the ink ribbon 9A is wound in a roll. The supply roll 90A is configured by winding the ink ribbon 9A around the spool 921. The winding roll 90B is configured by winding the ink ribbon 9A around the spool 922.

The ink ribbon 9A is fed from the supply roll 90A by the printing device 2 and wound around the winding roll 90B. The shaft 92B is provided at the upper right corner of the lid 91. The shaft 92C is provided at the lower right corner of the lid 91. The shaft 92D is provided at the lower left corner of the lid 91. The shaft 92E is provided at the upper left corner of the lid 91. The ink ribbon 9A stretched between the supply roll 90A and the winding roll 90B is in contact with a part of a circumferential surface of each of the shafts 92B to 92E.

Platen Roller Q

As illustrated in FIGS. 1 and 2, the platen roller Q has a cylindrical shape. The platen roller Q is rotatable around a rotation axis extending in the front-and-rear direction. The printing device 2 is disposed above the platen roller Q. The print medium P and the ink ribbon 9A are sandwiched between the platen roller Q and a thermal head 24 of the printing device 2. The platen roller Q contacts the print medium P transport by the external apparatus 8 from below and presses the print medium P against the ink ribbon 9A.

Printing Device 2

Figure 3:
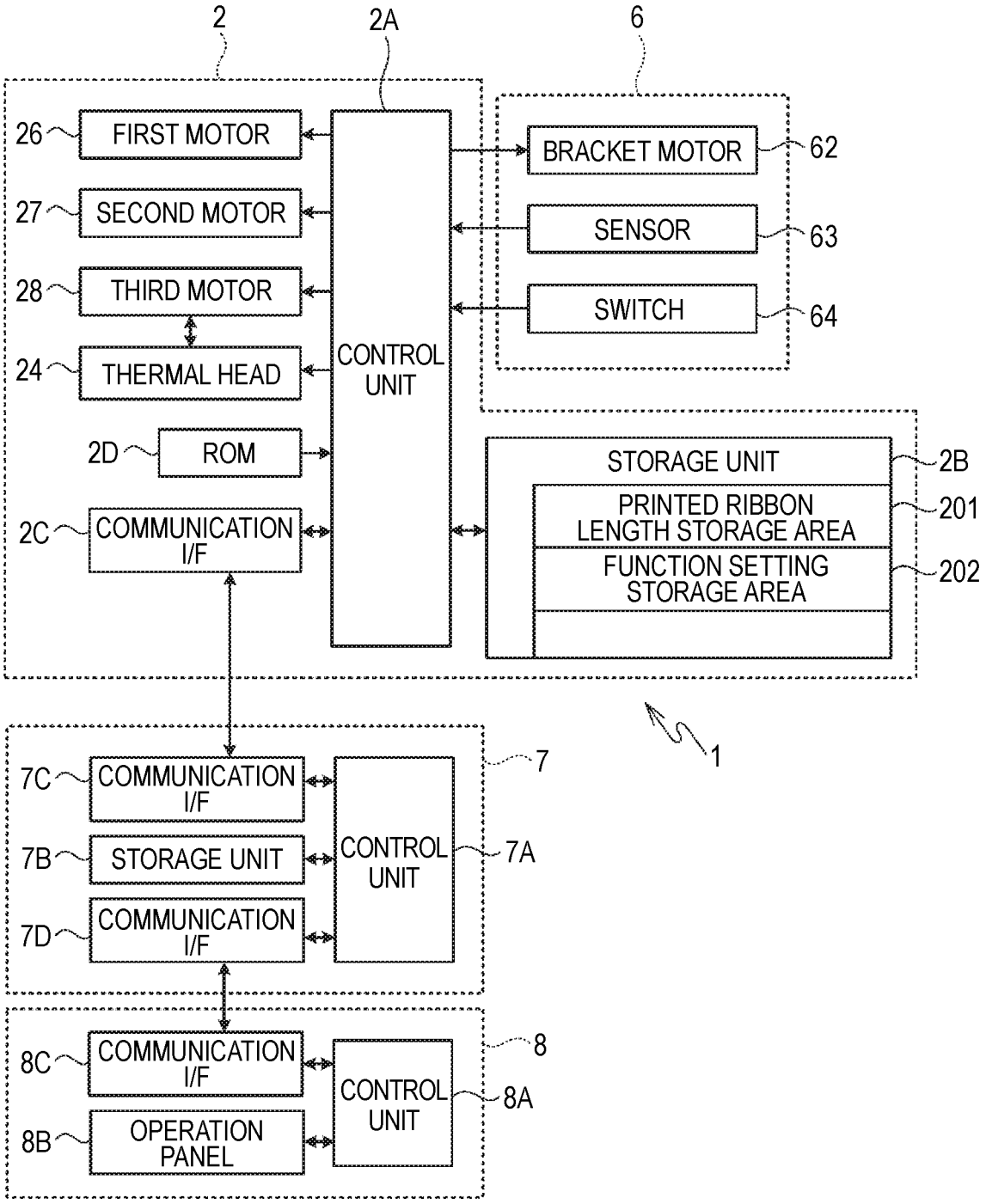
FIG. 3 is a block diagram illustrating an electrical configuration of the printing system.

The printing device 2 is a thermal transfer thermal printer. As illustrated in FIGS. 2 and 3, the printing device 2 includes a supply unit 22, a winding unit 23, the thermal head 24, a control board (not illustrated), a first motor 26, a second motor 27, a third motor 28, and the like. When the cassette 9 illustrated in FIG. 2 is attached to the cassette attachment unit 20 of the printing device 2, the shaft 92A is connected to the supply unit 22 and the shaft 92F is connected to the winding unit 23. The supply roll 90A wound around the spool 921 of the shaft 92A is attached to the supply unit 22. The winding roll 90B wound around the spool 922 of the shaft 92F is attached to the winding unit 23.

The first motor 26 and the second motor 27 are stepping motors. The first motor 26 can rotate the supply roll 90A attached to the supply unit 22 by rotationally driving the supply unit 22. The second motor 27 can rotate the winding roll 90B attached to the winding unit 23 by rotationally driving the winding unit 23. When the first motor 26 and the second motor 27 rotate in a state where the cassette 9 is attached to the printing device 2, the ink ribbon 9A is transported between the supply roll 90A and the winding roll 90B in the printing devices 2 while being guided in contact with the shafts 92B to 92E.

In detail, when the supply roll 90A and the winding roll 90B rotate in a forward rotation direction which is a counterclockwise direction, in a state where the printing device 2 in FIG. 2 is viewed from the front, the ink ribbon 9A is fed from the supply roll 90A and wound around the winding roll 90B. When the supply roll 90A and the winding roll 90B rotate in a reverse rotation direction which is the clockwise direction in a state where the printing device 2 in FIG. 2 is viewed from the front, the ink ribbon 9A is fed from the winding roll 90B and wound around the supply roll 90A.

The thermal head 24 is a line thermal head having a plurality of heating elements 25 linearly arranged in the front-and-rear direction. The thermal head 24 contacts a portion stretched between the shafts 92C and 92D of the ink ribbon 9A transported from the supply roll 90A of the cassette 9 toward the winding roll 90B from above. The print medium P and the ink ribbon 9A are sandwiched between the thermal head 24 and the platen roller Q disposed below the printing device 2. The thermal head 24 performs printing on the print medium P by heating the ink ribbon 9A while pressing the ink ribbon 9A against the print medium P.

The third motor 28 is a stepping motor. The third motor 28 moves the thermal head 24 between head positions 24A and 24B via a gear in the vertical direction. The thermal head 24 approaches the platen roller Q by moving downward, and is separated from the platen roller Q by moving upward. The movement direction (vertical direction) of the thermal head 24 is orthogonal to the transport direction (horizontal direction) of the ink ribbon 9A transported between the shafts 92C and 92D. The head position 24B is a position where the thermal head 24 contacts the ink ribbon 9A and urges the ink ribbon 9A toward the platen roller Q. The head position 24A is a position where the thermal head 24 is disposed above the head position 24B and urging of the ink ribbon 9A to the platen roller Q is released.

Bracket 6

As illustrated in FIG. 1, the bracket 6 moves the printing device 2 in the front-and-rear direction (direction of the arrow Y2) orthogonal to the horizontal direction which is the transport direction of the print medium P (see FIG. 2). The bracket 6 includes a support portion 61, a bracket motor 62, a lead screw (not illustrated), and a ball screw (not illustrated). The support portion 61 has a substantially box shape that is long in the front-and-rear direction. The lead screw is disposed inside the support portion 61 and extends in the front-and-rear direction. The rear end portion of the lead screw is coupled to a rotation shaft of the bracket motor 62. The ball screw is screwed into the lead screw, and moves in the front-and-rear direction according to rotation of the lead screw. The ball screw is connected to a coupling portion 21 provided at the right end of the printing device 2. The printing device 2 moves in the front-and-rear direction according to the movement of the ball screw in the front-and-rear direction by rotation of the lead screw.

Controller 7

As illustrated in FIG. 3, the controller 7 is interposed between the printing device 2 and the external apparatus 8. The controller 7 outputs data necessary for the printing device 2 to perform printing to the printing device 2. A specific example of data output from the controller 7 to the printing device 2 includes data of a print image. The controller 7 also transmits a signal output from the external apparatus 8 to the printing device 2. Examples of the signals output from the external apparatus 8 include a transport start signal/transport stop signal of the print medium P, a speed signal indicating the transport speed of the print medium P, and a print signal for notifying a printing time for the print medium P.

Electrical Configuration

An electrical configuration of the printing system 1 will be described with reference to FIG. 3. The printing device 2 includes a control unit 2A, a storage unit 2B, a communication interface 2C, a ROM 2D, a thermal head 24, a first motor 26, a second motor 27, and a third motor 28. The control unit 2A, the storage unit 2B, the ROM 2D, and the communication interface 2C are equipped in a control board (not illustrated). The control unit 2A is electrically connected to the storage unit 2B, the ROM 2D, the communication interface 2C, the thermal head 24, the first motor 26, the second motor 27, and the third motor 28. The control unit 2A is configured by a CPU and the like. The storage unit 2B is configured by a volatile memory such as a RAM.

The control unit 2A executes a function setting process, a first rewind printing process to a third rewind printing process, a rewind function OFF printing process, and the like by reading and executing a program stored in the ROM 2D. The storage unit 2B includes a printed ribbon length storage area 201, a function setting storage area 202, and the like. The printed ribbon length storage area 201 stores a "printed ribbon length" which is a length of the ink ribbon 9A which is subjected to printing and positioned closer to the supply unit 22 than the thermal head 24. The function setting storage area 202 stores a function to be set. As an example, the function setting storage area 202 stores the setting of ON or OFF of the rewind function. The communication interface 2C is an interface element for communicating between the printing device 2 and the controller 7. The communication interface 2C is connected to the controller 7 via a communication cable.

The thermal head 24 generates heat by energizing heating elements 25 in accordance with a control signal from the control unit 2A. The first motor 26 rotates the supply unit 22 by rotating according to a pulse signal output from the control unit 2A. The second motor 27 rotates the winding unit 23 by rotating according to the pulse signal output from the control unit 2A. The third motor 28 moves the thermal head 24 in the vertical direction by rotating according to the pulse signal output from the control unit 2A.

The bracket 6 includes a bracket motor 62, a sensor 63, and a switch 64. The bracket motor 62 moves the printing device 2 in the front-and-rear direction by rotating according to the pulse signal output from the control unit 2A. The sensor 63 is a contact type sensor capable of detecting a position of the printing device 2 in the front-and-rear direction. The switch 64 is a push button switch to which an instruction for the bracket 6 is input.

The controller 7 includes a control unit 7A, a storage unit 7B, and communication interfaces 7C and 7D. The communication interface 7C is an interface element for communicating between the printing device 2 and the controller 7. The communication interface 7C is connected to the printing device 2 via a communication cable. The communication interface 7D is an interface element for communicating between the external apparatus 8 and the controller 7. The communication interface 7D is connected to the external apparatus 8 via a communication cable. The storage unit 7B is configured by a nonvolatile memory as an example. Data required for the printing device 2 to perform printing is stored in the storage unit 7B. The control unit 7A is electrically connected to the storage unit 7B and the communication interfaces 7C and 7D. The control unit 7A reads data required for the printing device 2 to perform printing from the storage unit 7B, and outputs the data to the printing device 2 via the communication interface 7C. The control unit 7A detects a signal received from the external apparatus 8 via the communication interface 7D, and outputs the signal to the printing device 2 via the communication interface 7C.

Menu List

A menu list 70 illustrated in FIG. 4 is stored in the storage unit 7B. The menu list 70 is table data in which setting contents of a plurality of functions set in the printing device 2 are associated with a menu number (identification code). As an example, menu number 1 indicates settings of a plurality of functions including a first rewind function ON printing process described later, menu number 2 indicates settings of a plurality of functions including a second rewind function ON printing process described later, menu number 3 indicates settings of a plurality of functions including a third rewind function ON printing process described later, and menu number 4 indicates settings of a plurality of functions including a rewind function OFF printing process described later. When a signal indicating the menu number is received from the external apparatus 8, the control unit 7A of the controller 7 refers to setting contents of the plurality of functions corresponding to the received menu number, and transmits a signal indicating the setting contents to the control unit 2A of the printing device 2.

The external apparatus 8 includes a control unit 8A, an operation panel 8B, and a communication interface 8C. An instruction to the external apparatus 8 is input to the operation panel 8B. The communication interface 8C is an interface element for communicating between the external apparatus 8 and the controller 7. The communication interface 8C is connected to the controller 7 via a communication cable. The control unit 8A is electrically connected to the operation panel 8B and the communication interface 8C. The control unit 8A receives an instruction input to operation panel 8B. The control unit 8A outputs various signals to the controller 7 via the communication interface 8C.

Function Setting Process

A function setting process of the printing device 2 will be described with reference to FIGS. 4 and 5. When the printing device 2 is powered on, the control unit 2A reads a program of the function setting process illustrated in FIG. 5 from the ROM 2D and executes the program. First, the control unit 2A determines whether a function setting instruction is received (S51). As an example, when the operation panel 8B of the external apparatus 8 is operated and any menu number of the menu list 70 illustrated in FIG. 4 is input, the control unit 8A outputs the menu number to the controller 7 via the communication interface 8C. The control unit 7A of the controller 7 refers to the menu list 70 based on the received menu number, and specifies the setting content to be set in the printing device 2. The control unit 7A outputs a signal indicating the specified setting content to the printing device 2 via the communication interface 7C.

The control unit 2A of the printing device 2 that has received the signal of the setting content determines that the function setting instruction is received (YES in S51). Next, the control unit 2A determines whether a rewind function setting instruction is received (S52). As an example, when the signal of menu number 1 is transmitted from the external apparatus 8 to the controller 7 and a signal of a first rewind function ON printing process is transmitted from the controller 7 to the printing device 2, the control unit 2A determines that the function setting instruction is received (YES in S51) and the rewind function setting instruction is received (YES in S52). Next, the control unit 2A determines whether a rewind function ON instruction is received (S54). For example, when a signal of the first rewind function ON printing process is transmitted, the control unit 2A determines that rewind function ON instruction is received (YES in S54). Next, the control unit 2A stores a rewind function ON in the function setting storage area 202 of the storage unit 2B (S55). Next, the control unit 2A executes a designated rewind printing process (S56). As an example, the control unit 2A reads a program of the first rewind function ON printing process from the ROM 2D and executes the program.

When it is determined that the determination result in S51 is NO, the control unit 2A returns the process to S51. When it is not determined, in the determination of S52, that the setting of the rewind function is received (NO in S52), the control unit 2A performs other setting based on the received signal (S53). When it is not determined, in the determination of S54, that the rewind function is ON received (NO in S54), the control unit 2A stores a rewind function OFF in the function setting storage area 202 of the storage unit 2B (S57). Next, the control unit 2A reads a program of a rewind function OFF printing process from the ROM 2D and executes the program (S58).

In the printing system 1, since the storage unit 7B of the controller 7 stores the menu list 70, when the control unit 7A receives a menu number from the external apparatus 8, the control unit 7A can easily set a plurality of functions corresponding to the menu number.

First Rewind Function ON Printing Process

Figure 6:
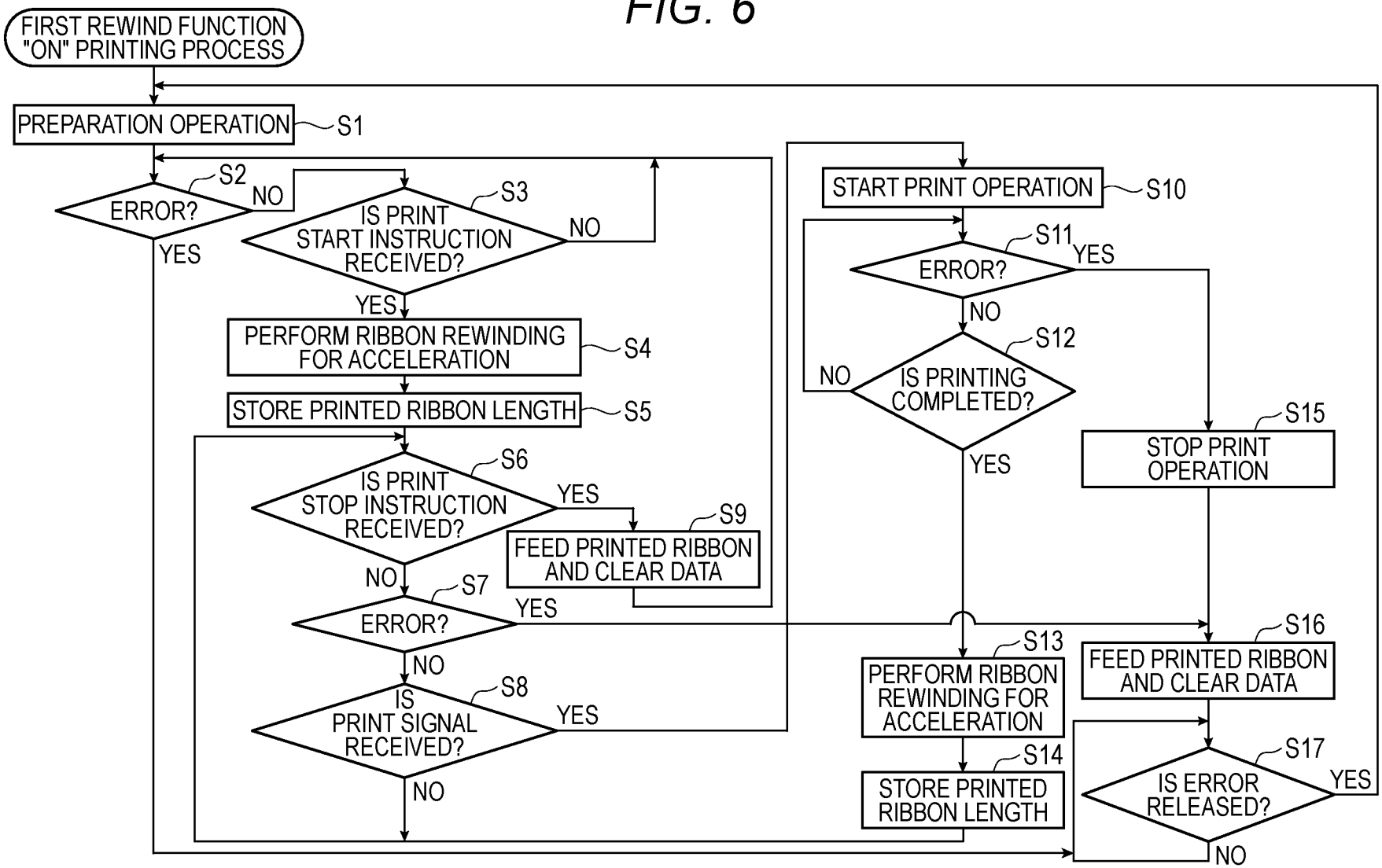
FIG. 6 is a flowchart of a first rewind function ON printing process.

A case where the rewind function ON is stored in the function setting storage area 202 and the first rewind function ON printing process is executed in the function setting process will be described with reference to FIG. 6. First, the control unit 2A performs a preparation operation (S1). One example of the preparation operation is measurement of a diameter of the supply roll 90A. The control unit 2A calculates the diameter of the supply roll 90A based on the number of steps when the first motor 26 is rotationally driven to rotate the supply roll 90A and the number of pulses output from an encoder (not illustrated) provided on the shaft 92B.

Next, the control unit 2A determines whether an error has occurred in the function of the printing device 2 (S2). An example of an error is a case where the cassette 9 is not attached to the cassette attachment unit 20, and the control unit 2A receives a signal indicating that the cassette 9 is not attached from a cassette sensor (not illustrated). When it is determined that an error has occurred (YES in S2), the control unit 2A determines whether the error is canceled (S17). As an example, when the cassette 9 is attached to the cassette attachment unit 20 and a signal indicating that the cassette 9 is attached is received from the cassette sensor (not illustrated), the control unit 2A determines that the error is released (YES in S17), the process proceeds to S1. When it is not determined that the error is released (NO in S17), the control unit 2A performs the determination of S17 until the error is released. When it is not determined that an error has occurred (NO in S2), the control unit 2A determines whether a signal indicating a print start instruction is received (S3). As an example, when the control unit 2A receives a signal indicating a print start instruction transmitted from the external apparatus 8 via the controller 7, the control unit 2A determines that the print start instruction is received (YES in S3).

The controller 7 outputs data indicating a signal print image to the printing device 2 together with the print start instruction signal. According to the start of transport of the print medium P by the external apparatus 8, a transport start signal for starting transport of the print medium P and a speed signal indicating a transport speed of the print medium P are output from the external apparatus 8. The printing device 2 receives the transport start signal and the speed signal via the controller 7. When the print start instruction is not received (NO in S3), the control unit 2A causes the process to proceed to S2.

Figure 7A:
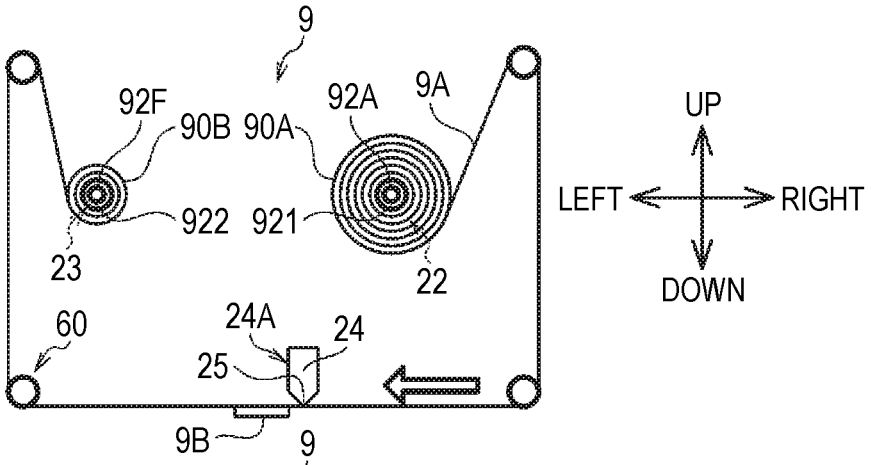
FIGS. 7A to 7D are views illustrating rewinding operations of a printed ribbon length.
Figure 7B:
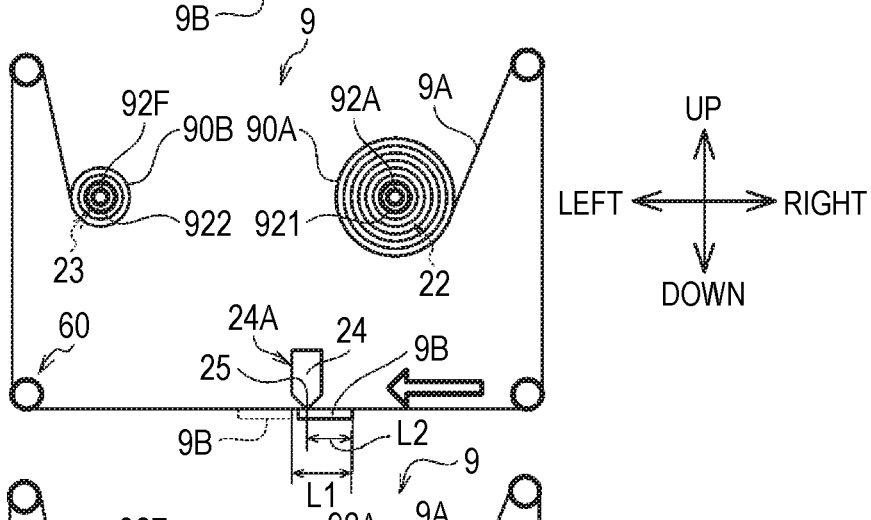

When it is determined that the print start instruction is received (YES in S3), the control unit 2A performs ribbon rewinding for acceleration (S4). As illustrated in FIG. 7A, in a state where the previous printing has been completed, a uses area 9B used for printing on the ink ribbon 9A is positioned closer to the winding portion 23 side than the heating element 25 of the thermal head 24. This is because the ink ribbon 9A is transported by a length corresponding the deceleration until the transport of the ink ribbon 9A is stopped. In FIGS. 7A to 7D, the used area 9B is rendered to protrude downward, but in actuality, the used area 9B is a print mark in which the ink ribbon 9A is used. In an acceleration ribbon rewinding process (S4), the control unit 2A rotationally drives the first motor 26 and the second motor 27 to rotate the supply roll 90A and the winding roll 90B in the reverse rotation direction to rewind the ink ribbon 9A to the supply roll 90A side of the supply unit 22 (which is one example of a second direction), as illustrated in FIG. 7B. A length L1 of the ink ribbon 9A that is rewound in the acceleration ribbon rewinding process (S4) is a length by which the ink ribbon 9A is transported until the transport of the ink ribbon 9A is started from a stopped state thereof and the printing is started by the thermal head 24.

Next, the control unit 2A stores a printed ribbon length L2, which is a length of the ink ribbon 9A subjected to printing and positioned closer to the supply unit 22 than the thermal head 24, in the storage unit 2B (S5). As an example, in the example illustrated in FIG. 7B, the printed ribbon length L2 is a length to the end portion of the supply unit 22 side of the used area 9B of the ink ribbon 9A which is subjected to printing and positioned closer to the supply unit 22 side than the heating element 25 of the thermal head 24. Since the first motor 26 and the second motor 27 are stepping motors, the number of steps of the stepping motors is converted into a length using a roll diameter as the printed ribbon length L2, and then the length is stored in the storage unit 2B. As an example, assuming that a motor pulse number corresponding to L2 is 50 pulses and the number of steps of one complete revolution of the stepping motor is 1000 pulses, and the roll diameter is 100 mm, the control unit 2A calculates L2 as follows.

$$L2=100\times\pi\times(50/1000)\cong15.7\text{ mm}$$

Next, the control unit 2A determines whether a signal indicating a print stop instruction is received (S6). As an example, when a signal indicating the print stop instruction transmitted from the external apparatus 8 is received via the controller 7, the control unit 2A determines that the signal indicating the print stop instruction is received. When it is not determined that the signal indicating the print stop instruction is received (NO in S6), the control unit 2A determines whether an error has occurred similarly as in S2 (S7). When it is not determined that an error has occurred (NO in S7), the control unit 2A determines whether a print signal instructing the timing of starting printing by the thermal head 24 is received via the controller 7 (S8). When it is determined that the print signal is received (YES in S8), the control unit 2A starts a print operation (S10).

In the print operation (S10), as an example, the control unit 2A rotationally drives the first motor 26 and the second motor 27 to rotate the supply roll 90A and the winding roll 90B in the forward rotation direction so that the ink ribbon 9A is transported at a speed synchronized with a transport speed indicated by the speed signal. The ink ribbon 9A moves to the left at a speed synchronized with the print medium P in a transport path between the shafts 92C and 92D after being subjected to acceleration. An example of the synchronized speed is the same speed as the transport speed of the print medium P, but it is not necessarily limited to the same speed as long as it is a speed at which the ink ribbon 9A can print on the print medium P. The ink ribbon 9A and the print medium P run in parallel to each other to the left. The control unit 2A rotationally drives the third motor 28 to move the thermal head 24 downward from the head position 24A to the head position 24B. The thermal head 24 sandwiches the ink ribbon 9A and the print medium P with the platen roller Q, and presses the ink ribbon 9A against the print medium P. The heating elements 25 of the thermal head 24 generate heat based on data stored in the storage unit 2B. Ink of the ink ribbon 9A is transferred to the print medium P and the print image is printed. Next, the control unit 2A moves the thermal head 24 upward from the head position 24B to the head position 24A, stops the first motor 26 and the second motor 27, and stops the transport of the ink ribbon 9A.

Next, the control unit 2A determines whether an error has occurred similarly as in S2 (S11). In a case where it is not determined that an error has occurred (NO in S11), when it is determined that printing is completed (YES in S12), the control unit 2A performs the ribbon rewinding for acceleration similarly as in S4 (S13). The length by which the ink ribbon 9A is rewound is L1. Next, the control unit 2A stores the printed ribbon length L2, which is the length of the ink ribbon 9A subjected to printing and positioned closer to the supply unit 22 than the heating elements 25 of the thermal head 24, in the storage unit 2B (S14), and causes the process to proceed to S6. Hereinafter, the control unit 2A repeats the processes of S7 to S14 as long as the signal indicating the print stop instruction is not received (NO in S6).

Figure 7C:
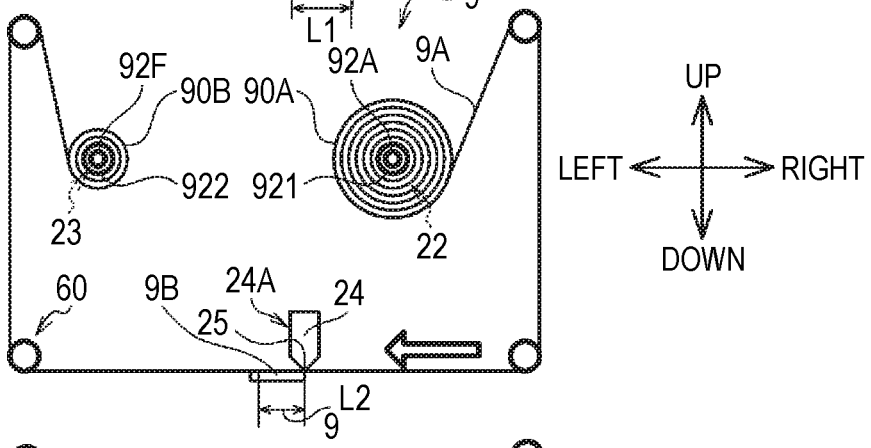

When it is determined that the signal indicating the print stop instruction is received (YES in S6), the control unit 2A performs feeding of the printed ribbon (S9). The control unit 2A rotationally drives the first motor 26 and the second motor 27 to rotate the supply roll 90A and the winding roll 90B in the forward rotation direction to feed the ink ribbon 9A to the winding unit 23 side (which is one example of a first direction) and wind the ink ribbon 9A around the winding roll 90B. As illustrated in FIG. 7C, the length of the ink ribbon 9A to be fed out is the printed ribbon length L2 stored in the storage unit 2B in the process of S5. As an example, the control unit 2A rotationally drives the first motor 26 and the second motor 27 in the forward rotation direction by the number of steps corresponding to the printed ribbon length L2 stored in the storage unit 2B. Accordingly, the used area 9B is not present on the side closer to the supply unit 22 than the heating element 25 of the thermal head 24. After feeding the printed ribbon, the control unit 2A clears data of the printed ribbon length L2 stored in the storage unit 2B (S9). Next, control unit 2A causes the process to proceed to S2. The ink ribbon 9A is held at the transport position illustrated in FIG. 7C until the next print start instruction signal is received. The control unit 2A causes the process to proceed to S2.

In a case where it is not determined that an error has occurred (NO in S2), when it is determined that a signal indicating a print start instruction is received via the controller 7 (YES in S3), the control unit 2A performs the ribbon rewinding for acceleration, similarly as described above (S4). A length L3 (see FIG. 7D) of the ink ribbon 9A to be rewound with the ribbon rewinding for acceleration (S4) this time is a length by which the ink ribbon 9A is transported until the ink ribbon 9A is started to be transported from the stopped state, the transport speed of the ink ribbon 9A is synchronized with the transport speed of the print medium P, and printing is started by the thermal head 24. As an example, the length L3 becomes longer as a speed signal indicating the transport speed of the print medium P received together with the signal of the print start instruction this time becomes faster, and the length L3 becomes shorter as the speed signal becomes slower. Hereinafter, the control unit 2A performs the processes of S5 to S14 similarly as described above.

When it is determined, in the determination of S7, that an error has occurred (YES in S7), the control unit 2A feeds the printed ribbon similarly as in the process of S9 (S16). The length of the fed ink ribbon 9A is the printed ribbon length L2 stored in the storage unit 2B in the process of S5. In the process of S16, the control unit 2A clears data of the printed ribbon length L2 stored in the storage unit 2B after the printed ribbon is fed. Next, when it is determined that the error is released (YES in S17), the control unit 2A returns the process to S1. When it is not determined that the error is released (NO in S17), the control unit 2A performs the determination of S17 until the error is released.

When it is determined that an error has occurred in the determination of S11 (YES in S11), the control unit 2A stops the print operation (S15). As an example, the control unit 2A stops energization to the thermal head 24, rotationally drives the third motor 28, and moves the thermal head 24 upward from the head position 24B to the head position 24A. The control unit 2A stops the rotation of the first motor 26 and the second motor 27. With this configuration, the rotation of the supply roll 90A and the winding roll 90B is also stopped, and the transport of the ink ribbon 9A is stopped.

Next, the control unit 2A performs feeding of the printed ribbon similarly as described above (S16). The length of the fed ink ribbon 9A is the printed ribbon length L2 stored in the storage unit 2B in the process of S5 or S14. In the process of S16, the control unit 2A clears the data of the printed ribbon length L2 stored in the storage unit 2B after the printed ribbon is fed. When it is determined that the error is released (YES in S17), the control unit 2A returns the process to S1. When it is not determined that the error is released (NO in S17), the control unit 2A performs the determination of S17 until the error is released.

Figure 7D:
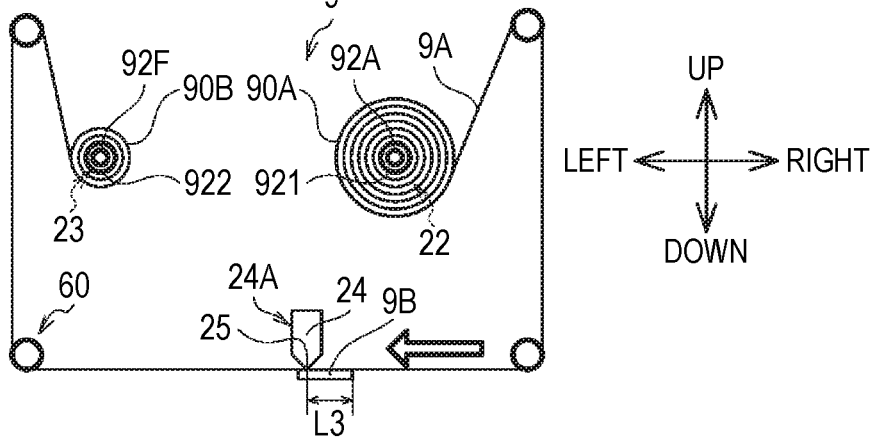
Figure 8:
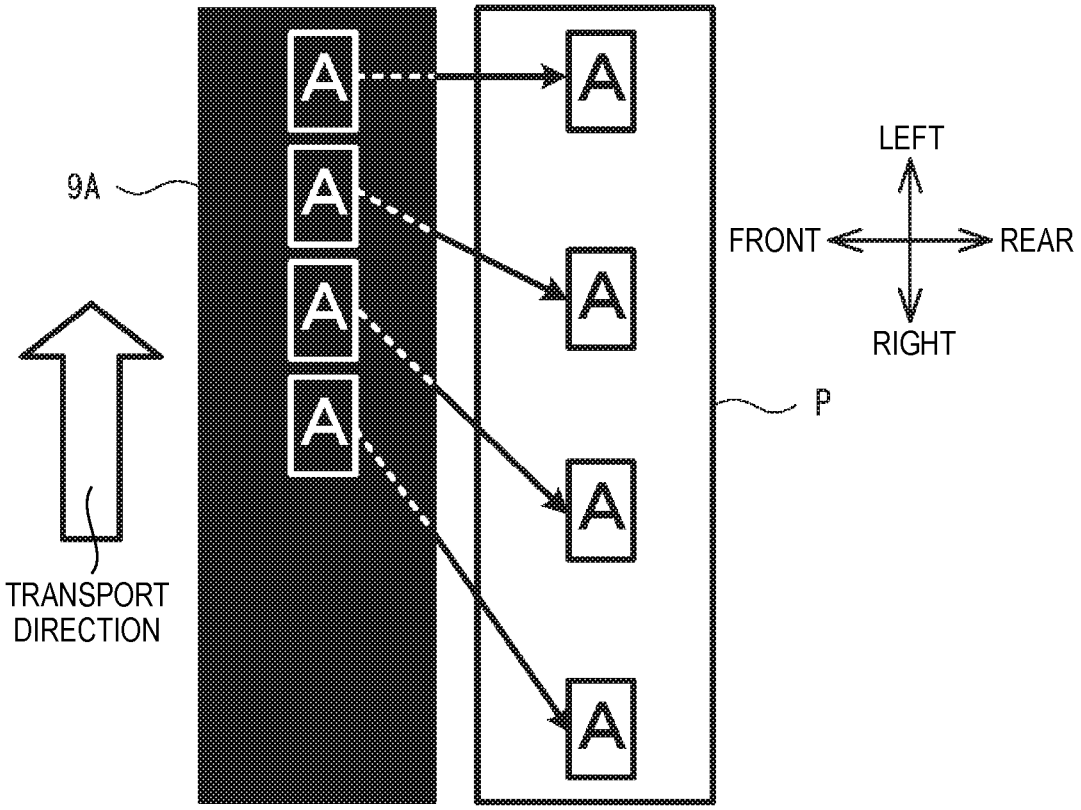
FIG. 8 is a view illustrating a used area (print mark) of an ink ribbon.

As described above, in the printing system 1 that performs the first rewind function ON printing process, the printed ribbon length L2, which is the length of the ink ribbon 9A subjected to printing and positioned closer to the supply unit 22 than the heating element 25 of the thermal head 24, is stored in the storage unit 2B. As illustrated in FIG. 7C, after the printing is stopped, the ink ribbon 9A is fed from the supply unit 22 side to the winding unit 23 side by the printed ribbon length L2 stored in the storage unit 2B. Accordingly, at this stage, the ink ribbon 9A subjected to printing and positioned closer to the supply section 22 than the heating element 25 of the thermal head 24 is not present. Next, after receiving a print command again, the ribbon rewinding for acceleration is performed. Accordingly, as illustrated in FIG. 7D, the ink ribbon 9A can be rewound to the supply roll 90A of the supply unit 22 by the length L3 for acceleration required for the printing this time. Accordingly, in the printing system 1, it is possible to prevent an excess or deficiency in the rewinding amount of the ink ribbon 9A. Accordingly, as illustrated in FIG. 8, a possibility of increasing the unused area in the ink ribbon 9A can be reduced. It is possible to reduce the possibility that the used area of the ink ribbon 9A overlaps the used area in the previous printing to cause the occurrence of unclear printing results.

In the printing system 1, when it is determined that the printing stop instruction is received (YES in S6), it is possible to quickly start the printing process without performing the feeding process at the start of the next printing, by performing the feeding process (S9) of the printed ribbon.

In the printing system 1, in the feeding processes (S9 and S16), the control unit 2A obtains the number of steps of the first motor 26 and the second motor 27, which are stepping motors, from the printed ribbon length L2 stored in the storage unit 2B. Next, the control unit 2A drives the stepping motor based on the determined number of steps to perform the feeding processes (S9 and S16) of the ink ribbon 9A, and thus the ink ribbon 9A can be fed to the winding unit 23 side with an accurate length. Therefore, it is possible to prevent occurrence of an excess or deficiency in the rewinding amount of the ink ribbon 9A.

In the printing system 1, since the control unit 2A clears data of the printed ribbon length L2 stored in the storage unit 2B (S9 and S16) after feeding the printed ribbon, memory of the printed ribbon length L2 is retained, and it is possible to prevent the printed ribbon length to be fed in the feeding process of the printed ribbon from being an incorrect length. In the printing system 1, since the control unit 2A drives the first motor 26 and the second motor 27 based on the number of steps of the stepping motor stored in the storage unit 2B to perform the feeding process of the printed ribbon, the ink ribbon 9A can be fed out to the winding unit 23 side with an accurate length. Thus, it is possible to reduce the possibility that an excess or deficiency occurs in the rewinding amount of the ink ribbon 9A. Therefore, in the printing system 1, when the rewind function is ON, the ink ribbon 9A can be saved as compared with a case where the rewinding process is not performed.

Second Rewind Function ON Printing Process

Figure 5:
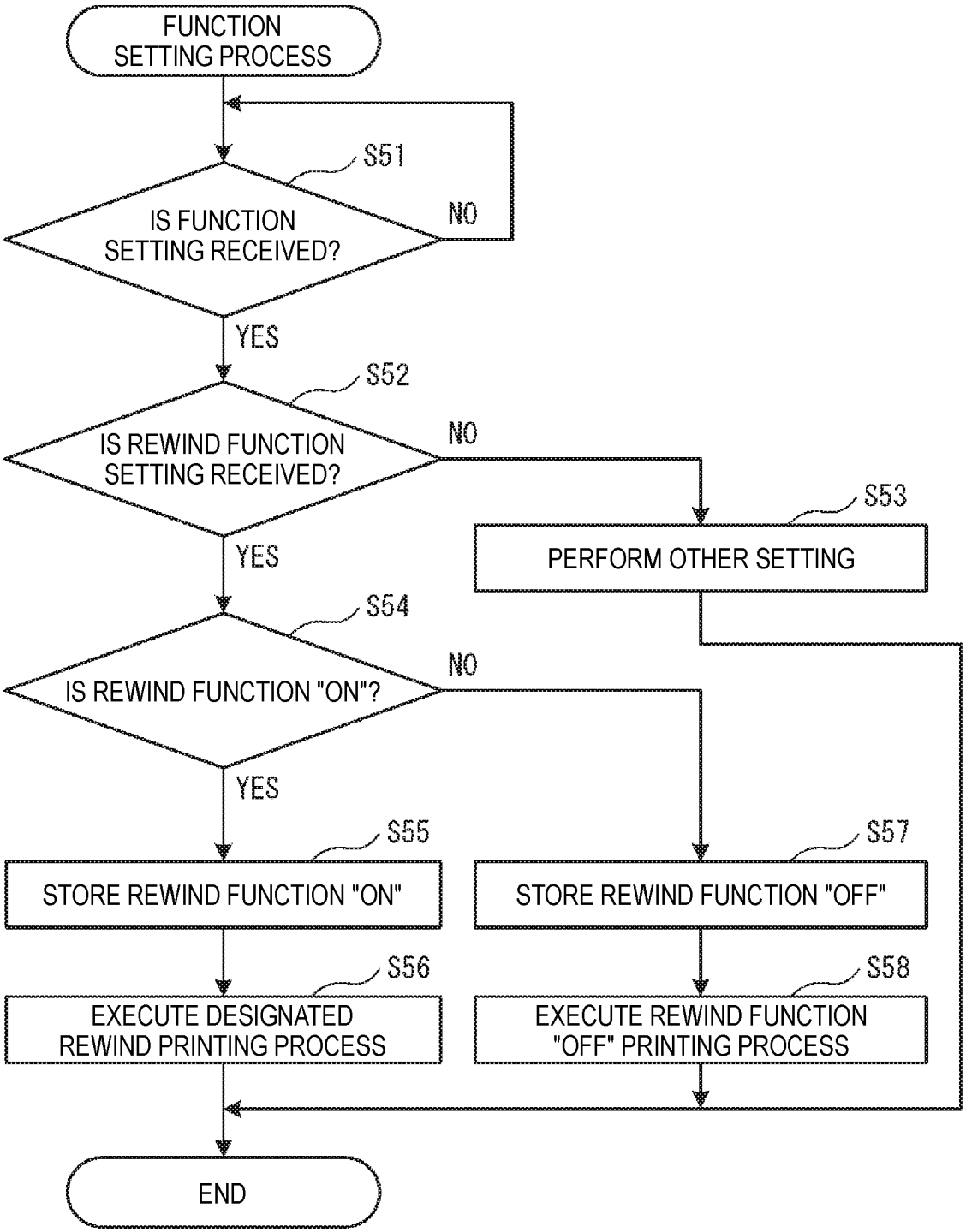
FIG. 5 is a flowchart of a function setting process.
Figure 9:
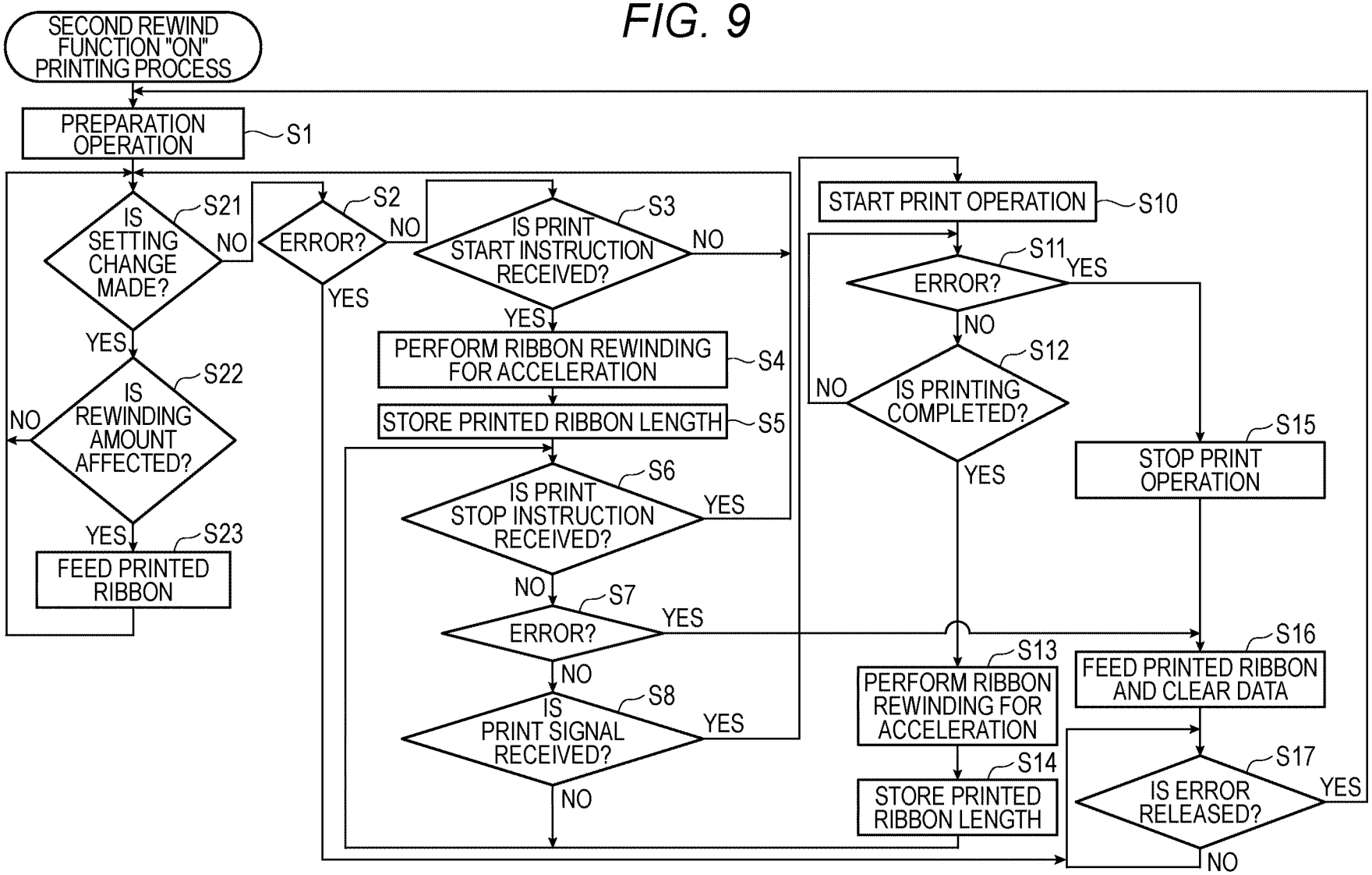
FIG. 9 is a flowchart of a second rewind function ON printing process.

When the menu number 2 is transmitted from the external apparatus 8 to the controller 7 and a signal of a second rewind function ON printing process from the controller 7 is transmitted to the printing device 2, in the function setting process illustrated in FIG. 5, the rewind function ON is stored in the function setting storage area 202 (S55), and the second rewind function ON printing process (S56) is executed. Hereinafter, description will be made with reference to FIG. 9. In the second rewind function ON printing process, the same processes as the first rewind function ON printing process are assigned the same step numbers. First, the control unit 2A performs a preparation operation (S1). The preparation operation (S1) is the same process as the preparation operation (S1) of the first rewind function ON printing process, and thus the description thereof is omitted. Next, the control unit 2A determines whether a setting change is made in the printing device 2 (S21). An example of the setting change is a case where the cassette 9 with a different width or material of the ink ribbon 9A is attached. In this case, a signal indicating that the cassette 9 has been replaced with a different type of cassette is input to the control unit 2A from a cassette identification sensor (not illustrated). A case where the speed signal indicating the transport speed of the print medium P output from the external device 8 and received via the controller 7 is changed is also an example of the setting change. Accordingly, in these cases, the control unit 2A determines that the setting change has been made in the printing device 2 (YES in S21).

Next, the control unit 2A determines whether the setting change affects the rewinding amount of the ink ribbon 9A performed in the acceleration ribbon rewinding processes (S4 and S13) (S22). If the width, material, and winding length of the ink ribbon 9A are different, the ink ribbon 9A is accelerated to a speed synchronized with the transport speed of the print medium P and a predetermined length of the ink ribbon 9A required to reach the printable speed changes. Accordingly, the length of the ink ribbon 9A rewound with the ribbon rewinding for acceleration (S4 and S13) changes. If the transport speed of the print medium P changes, the ink ribbon 9A is accelerated to a speed synchronized with the transport speed of the print medium P, and the predetermined length of the ink ribbon 9A required to reach the printable speed changes. In these cases, the control unit 2A determines that the rewinding amount of the ink ribbon 9A is affected (YES in S22).

When it is determined that the rewinding amount of the ink ribbon 9A is affected (YES in S22), the control unit 2A performs feeding of the printed ribbon (S23). The length of the ink ribbon 9A to be fed is the printed ribbon length L2 stored in the storage unit 2B in the previous storing processes (S5 and S14). When it is not determined that the rewinding amount of the ink ribbon 9A is affected (NO in S22), the control unit 2A causes the process to proceed to S21. When it is not determined that the setting change is made in the printing device 2 (NO in S21), the control unit 2A performs the processes of S2 to S17. The processes of S2 to S17 are the same as the processes of S2 to S17 of the first rewind function ON printing process, respectively, and thus the description thereof is omitted.

As described above, in the printing system 1 that performs the second rewind function ON printing process, when an instruction to change the setting content that affects the predetermined length required to reach the printable speed is received (YES in S22), by performing the feeding process (S23) of the printed ribbon, the printing process can be started quickly without performing the feeding process of the printed ribbon at the start of the next printing.

Third Rewind Function ON Printing Process

Figure 10:
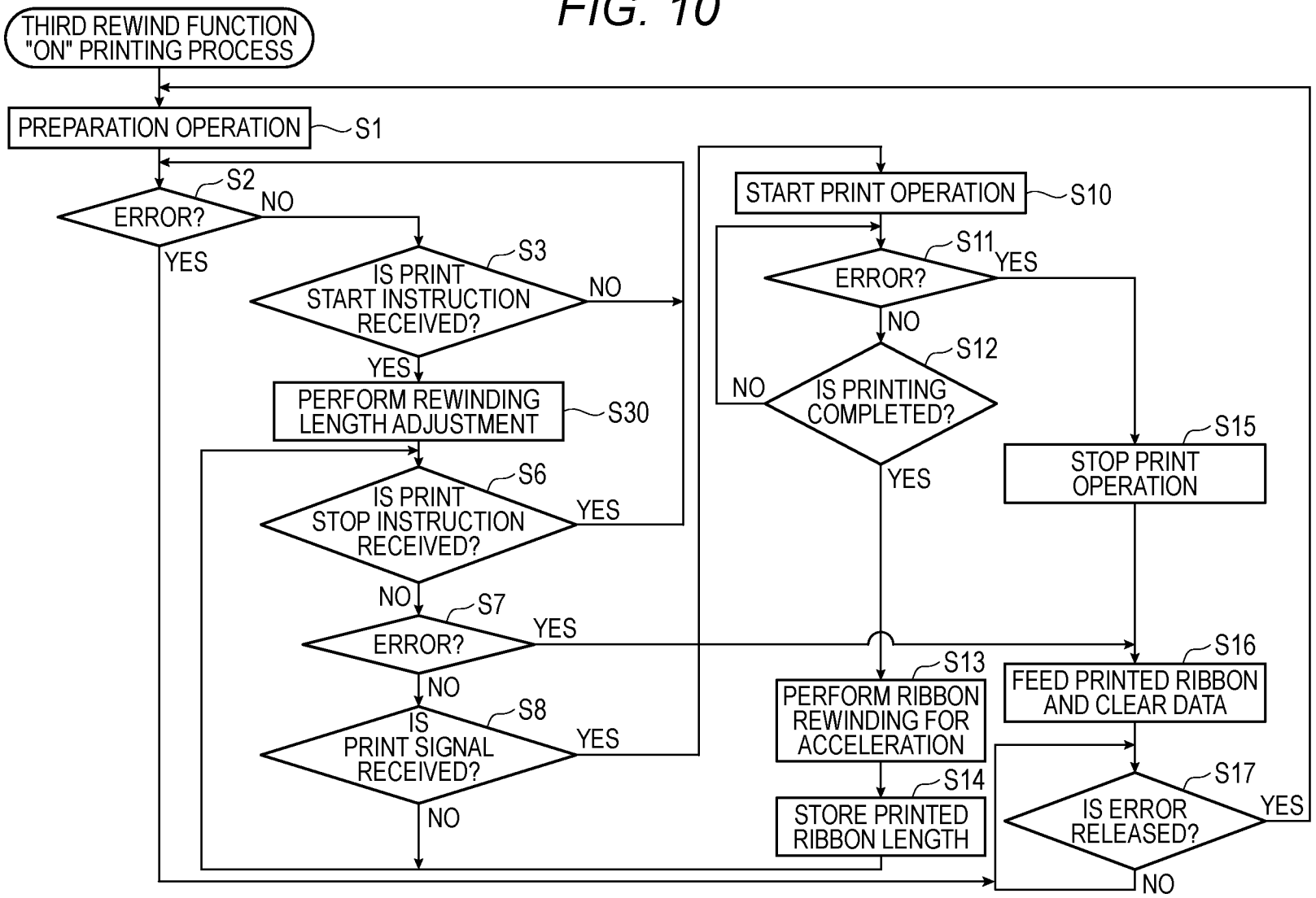
FIG. 10 is a flowchart of a third rewind function ON printing process.

When the menu number 3 is transmitted from the external apparatus 8 to the controller 7 and a signal of a third rewind function ON printing process from the controller 7 is transmitted to the printing device 2, in the function setting process illustrated in FIG. 5, the rewind function ON is stored in the function setting storage area 202 (S55), and the third rewind function ON printing process (S56) is executed. Hereinafter, description will be made with reference to FIG. 10. In the third rewind function ON printing process, the same processes as the first rewind function ON printing process are assigned the same step numbers. First, the control unit 2A performs a preparation operation (S1). The preparation operation (S1) is the same process as the preparation operation (S1) of the first rewind function ON printing process, and thus the description thereof is omitted. Since the process (S2) of determining the presence/absence of an error and the process (S3) of determining whether a print start instruction is received are also the same processes as those having the same process step numbers of the first rewind function ON printing process, the description thereof is omitted. When it is determined that the signal indicating the print start instruction is received (YES in S3), the control unit 2A performs a rewinding length adjustment process (S30).

Figure 11:
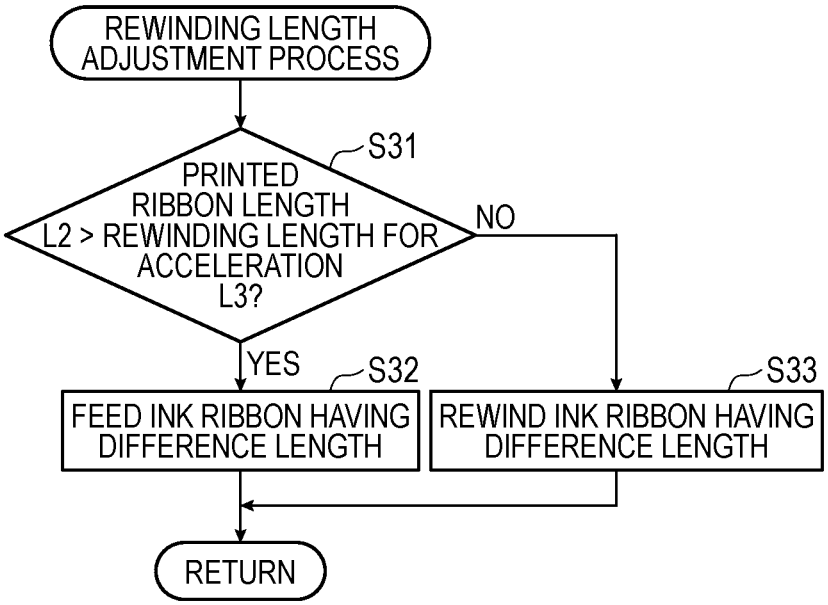
FIG. 11 is a subroutine of a rewinding length adjustment process.

The rewinding length adjustment process (S30) will be described with reference to a subroutine of FIG. 11. The control unit 2A determines whether the printed ribbon length L2 is greater than the rewinding length for acceleration L3 (S31). The printed ribbon length L2 (see FIG. 7B) is a length, which is stored in the storage unit 2B by the process of S14, of the ink ribbon 9A for which the previous printing is completed (YES in S12), for which the ribbon rewinding for acceleration is performed (S13), and which is subjected to printing and positioned closer to the supply unit 22 side than the heating element 25 of the thermal head 24. The rewinding length for acceleration L3 (see FIG. 7D) is a length by which the ink ribbon 9A is transported until the ink ribbon 9A is started to be transported from the stopped state thereof and the printing is started by the thermal head 24. That is, the rewinding length for acceleration L1 depends on the speed signal indicating the transport speed of the print medium P, which is output from the external device 8 and input to the control unit 2A via the controller 7, and a weight per unit length of the ink ribbon 9A.

When it is determined that the printed ribbon length L2 is greater than the rewinding length for acceleration L3 (YES in S31), the control unit 2A feeds the ink ribbon 9A having a difference length between the printed ribbon length L2 and the rewinding length for acceleration L3 to the winding unit 23 side (S32). This is because, when the L2 is greater than the L3, as illustrated in FIG. 16, the used area of the ink ribbon 9A already used for printing may be used again for printing at the time of the next printing. In the process of S32, as an example, the control unit 2A drives the first motor 26 and the second motor 27 by the number of steps of the difference between the L2 and the L3 to rotate the supply roll 90A and the winding roll 90B in the forward rotation direction (S32). Next, control unit 2A causes the process to proceed to S6.

When it is not determined that the printed ribbon length L2 is greater than the rewinding length for acceleration L3 (NO in S31), the control unit 2A rewinds the ink ribbon 9A having a difference length between the printed ribbon length L2 and the rewinding length for acceleration L3 to the supply unit 22 side (S33). This is because, when the L2 is not greater than the L3, that is, the L2 is less than or equal to the L3, as illustrated in FIG. 15, the unused area 101 of the ink ribbon 9A increases. Next, the control unit 2A causes the process to proceed to S6. The processes of S6 to S17 are the same as the processes of S6 to S17 of the first rewind function ON printing process, respectively, and thus the description thereof is omitted.

As described above, in the printing system 1 that performs the third rewind function ON printing process, since the process (S32) of feeding the ink ribbon 9A having a difference length between the printed ribbon length L2 and the rewinding length for acceleration L3 or the process (S33) of rewinding the ink ribbon 9A having the difference length is performed, the transport time of the ink ribbon 9A can be shortened, and the time to start printing can be shortened as compared with the case where the printed ribbon length L2 is fed and the rewinding length for acceleration L3 is rewound.

Rewind Function OFF Printing Process

Figure 12:
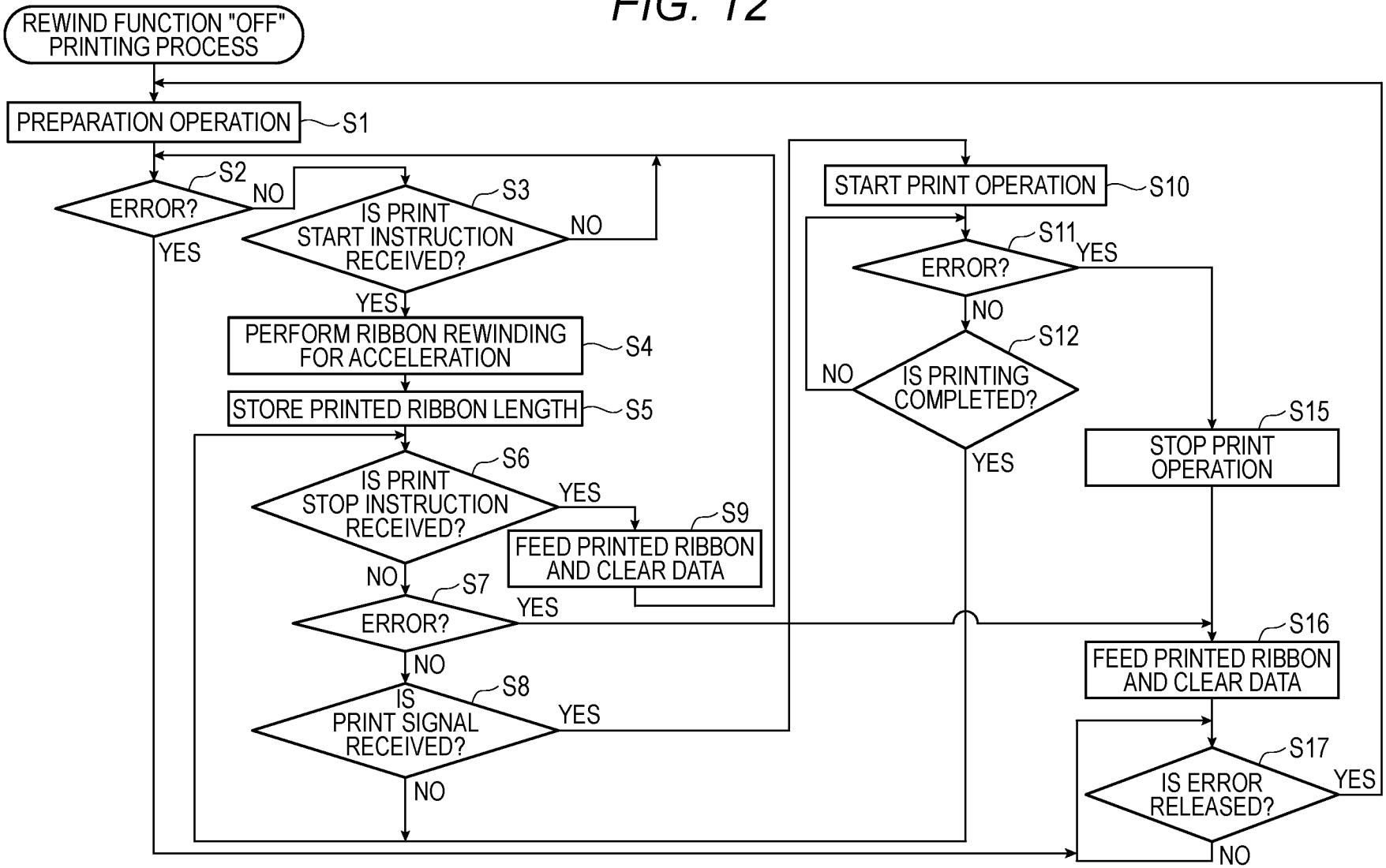
FIG. 12 is a flowchart of a rewind function OFF printing process.

When the menu number 4 is transmitted from the external apparatus 8 to the controller 7, the control unit 7A of the controller 7 transmits a signal of the rewind function OFF printing process to the printing device 2 based on the menu list 70. In the function setting process illustrated in FIG. 5, the rewind function OFF is stored in the function setting storage area 202 (S57) and the rewind function OFF printing process (S58) is executed. Hereinafter, description will be made with reference to FIG. 12. In the rewind function OFF printing process, the same processes as the first rewind function ON printing process are assigned the same step numbers. The description of the same process as the first rewind function ON printing process is omitted, and only different points will be described. In the rewind function OFF printing process, the control unit 2A starts the print operation (S10), and even when it is determined that the printing is completed (YES in S12), the control unit 2A does not perform the ribbon rewinding for acceleration (S13 in FIG. 6) and storing of the printed ribbon length L2 in the storage unit 2B (S14 in FIG. 6). Accordingly, the printing process can be performed at high speed.

When the signal indicating the print start instruction transmitted from the external apparatus 8 is received via the controller 7 and it is determined that the print start instruction is received (YES in S3), the control unit 2A performs the ribbon rewinding for acceleration (S4) and storing of the printed ribbon length L2 in the storage unit 2B (S5). When it is determined that the signal indicating the print stop instruction is received (YES in S6), the control unit 2A feeds the printed ribbon by the length L2, and clears data of the printed ribbon length L2 stored in the storage unit 2B (S9).

Figure 13:
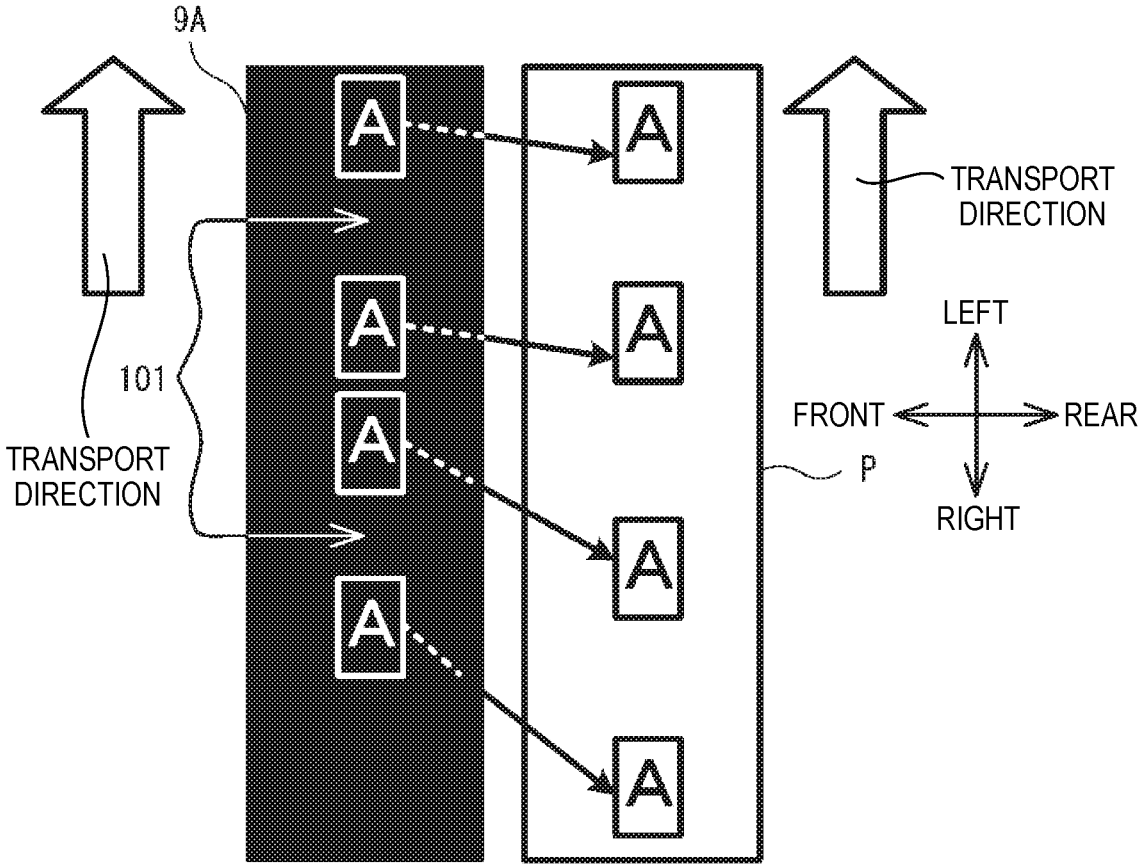
FIG. 13 is a view illustrating the uses area (print mark) of the ink ribbon by the rewind function OFF printing process.

As described above, in the printing system 1 for the rewind function OFF printing process, when it is determined that the print start instruction is received (YES in S3), the control unit 2A performs the ribbon rewinding for acceleration (S4) once, and does not perform the ribbon rewinding for acceleration in the subsequent print operation. Accordingly, as illustrated in FIG. 13, the unused area 101 can be saved once at the printing start timing, and thereafter, the printing process (S10) can be performed at high speed.

Modified Example

The disclosure is not limited to the above-described illustrative embodiment, and various altercations may be made thereto. In the above-described illustrative embodiment, the function setting process, the first rewind function ON printing process to the third rewind function ON printing process, and the rewind function OFF printing process are executed by the control unit 2A of the printing device 2. In contrast, a part or all of these processes may be executed by the control unit 7A of the controller 7 or the control unit 8A of the external apparatus 8. The control unit 2A is internally provided with a memory, and may be used instead of the storage unit 2B. The first motor 26 and the second motor 27 may be servo motors. In this case, the ribbon rewinding for acceleration (S4 and S13) and the feeding of the printed ribbon (S9 and S16) may be controlled by a phase of the servo motor. Storing (S5 and S14) of the printed ribbon length L2 in the storage unit 2B may be performed in such a way that the phase of the servo motor is converted into a length and store the length. In the rewind function OFF printing process, when it is determined that the print start instruction is received (YES in S3), the control unit 2A performs the ribbon rewinding for acceleration (S4) once but may not perform it at all. The printed ribbon feeding processes of S9 and S16 may not be performed at all.

When the first motor 26 and the second motor 27 are stepping motors, the printed ribbon length L2 stored in the storage unit 2B may be the number of steps by which the first motor 26 and the second motor 27 transport the ink ribbon 9A by the L2. In this case, the control unit 2A drives the first motor 26 and the second motor 27 based on the number of steps stored in the storage unit to perform the feeding processes (S9 and S16) of the ink ribbon 9A. Accordingly, in the printing system 1, the control unit 2A can feed the ink ribbon 9A to the winding unit 23 side with an accurate length. Therefore, it is possible to prevent occurrence of an excess or deficiency in the rewinding amount of the ink ribbon 9A. In the menu list 70, the setting content of one function may be associated with the menu number (identification code). The setting contents of one or more functions may be associated with the menu number (identification code).

Others

The control unit 2A is an example of the "control unit" in the disclosure. The storage unit 2B is an example of the "storage unit" in the disclosure. The first motor 26 and the second motor 27 are examples of the "ribbon transport mechanism" in the disclosure. The process of S10 is an example of the "printing process" in the disclosure. The process of S13 is an example of the "first rewinding process" in the disclosure. The process of S4 is an example of the "second rewinding process" of the disclosure. The processes of S5 and S14 are examples of the "storage process" of the disclosure. The processes of S9 and S16 are an example of the "feeding process" of the disclosure. The processes of S32 and S33 are an example of the "difference transport process" of the disclosure. The length L1 is an example of the "predetermined length" or the "first length" in the disclosure. The length L2 is an example of the "second length" in the disclosure. The length L3 is an example of the "third length" in the disclosure. The communication interface 2C is an example of the "interface" of the disclosure. The menu number is an example of the "identification number" in the disclosure.

The foregoing description of the illustrative embodiments of the disclosure has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the claims and their equivalents.

What is claimed is:

1. A printing system comprising:

a printing device comprising: a thermal head; a supplier configured to supply an ink ribbon to the thermal head; a winder provided opposite to the supplier with respect to the thermal head and configured to wind the ink ribbon; and a ribbon transport mechanism configured to transport the ink ribbon between the supplier and the winder;

an interface;

a storage; and a controller configured to:

transport the ink ribbon in a first direction with the ribbon transport mechanism and heat the ink ribbon with the thermal head to perform printing, the first direction being a direction from the supplier to the winder;

perform a first rewinding comprising rewinding the ink ribbon subjected to the printing in a second direction with the ribbon transport mechanism, the second direction being opposite to the first direction;

after again receiving a print command via the interface, perform a second rewinding comprising rewinding the ink ribbon by a first length in the second direction with the ribbon transport mechanism, the first length corresponding to a length required to reach a printable speed;

after performing each of the first rewinding and the second rewinding, store, in the storage, a second length, the second length corresponding to a length of the ink ribbon subjected to the printing upstream of the thermal head in the first direction; and feed the ink ribbon in the first direction by the stored second length with the ribbon transport mechanism.

2. The printing system according to claim 1, wherein the controller is configured to:

in the feeding, feed the ink ribbon in the first direction and clear the stored second length from the storage.

3. The printing system according to claim 1, wherein the controller is configured to store, in the storage, a setting of ON or OFF of a rewind function of rewinding the ink ribbon in the second direction with the ribbon transport mechanism, and wherein the controller is configured to control the ribbon transport mechanism based on the setting of ON or OFF of the rewind function stored in the storage.

4. The printing system according to claim 1, wherein the controller is configured to:

receive a setting of ON or OFF of a rewind function via the interface;

in a case the setting of ON of the rewind function is received, perform the printing, the first rewinding, the feeding, the second rewinding, and the storing; and in a case the setting of OFF of the rewind function is received, not perform the first rewinding, perform the second rewinding and the storing only once based on receiving a command to start printing via the interface, and then perform the printing.

5. The printing system according to claim 1, further comprising:

a stepping motor configured to drive the ribbon transport mechanism, wherein the controller is configured to store, in the storage, the number of steps of the stepping motor as the second length, and wherein the controller is configured to drive the stepping motor based on the number of steps stored in the storage to perform the feeding.

6. The printing system according to claim 1, wherein the storage stores a menu list in which one or more setting contents for setting a predetermined operation of the printing device are associated with an identification code, and wherein the controller is configured to, based on receiving the identification code via the interface, control one or more setting contents corresponding to the identification code.

7. The printing system according to claim 1, wherein the controller is configured to:

in a case a print stop instruction is received via the interface, perform the feeding.

8. The printing system according to claim 1, wherein the controller is configured to:

in a case an instruction to change setting contents affecting the first length is received via the interface, perform the feeding.

9. The printing system according to claim 1, wherein the printing system is the printing device comprising the interface and the controller.

10. A printing system comprising:

a printing device comprising: a thermal head; a supplier configured to supply an ink ribbon to the thermal head; a winder provided opposite to the supplier with respect to the thermal head and configured to wind the ink ribbon; and a ribbon transport mechanism configured to transport the ink ribbon between the supplier and the winder;

an interface;

a storage; and a controller configured to:

transport the ink ribbon in a first direction with the ribbon transport mechanism and heat the ink ribbon with the thermal head to perform printing, the first direction being a direction from the supplier to the winder;

perform a first rewinding comprising rewinding the ink ribbon subjected to the printing in a second direction with the ribbon transport mechanism, the second direction being opposite to the first direction;

after performing the first rewinding, store, in the storage, a second length, the second length corresponding to a length of the ink ribbon subjected to the printing upstream of the thermal head in the first direction; and after again receiving a print command via the interface, perform a difference transporting comprising:

in a case the stored second length is longer than a third length, feeding the ink ribbon in the first direction by a difference length between the second length and the third length with the ribbon transport mechanism, the third length corresponding to a length of the ink ribbon required to reach a printable speed; and in a case the stored second length is equal to or less than the third length, rewinding the ink ribbon in the second direction by the difference length with the ribbon transport mechanism.

* * * * *